United States Patent [19]

Begout et al.

[11] Patent Number: 4,825,218

[45] Date of Patent: Apr. 25, 1989

[54] REFLECTOR ANTENNA FOR TELECOMMUNICATIONS

[75] Inventors: Eric Begout, Nogent sur Marne; Alain Bourgeois, Eaubonne; Raymond Gueuret, Nanterre; Pascal Lapeyre, Ermont, all of France

[73] Assignee: Alcatel Thomason Faisceaux Hertizen, Perret Cedex, France

[21] Appl. No.: 35,823

[22] Filed: Apr. 8, 1987

[30] Foreign Application Priority Data

Dec. 18, 1986 [FR] France ..... 86 17758

[51] Int. Cl.[4] ..... H01Q 3/08

[52] U.S. Cl. ..... 343/765; 343/840; 343/882

[58] Field of Search ..... 343/765, 781 P, 781 CA, 343/781 R, 840, 880, 882

[56] References Cited

U.S. PATENT DOCUMENTS

| | | | |
|---|---|---|---|
| 3,076,964 | 2/1963 | Reinhold | 343/761 |
| 3,407,404 | 10/1968 | Cook et al. | 343/765 |
| 3,914,768 | 10/1975 | Ohm | 343/779 |
| 4,475,110 | 10/1984 | Hutchins | 343/882 |
| 4,490,726 | 12/1984 | Weir | 343/DIG. 1 |
| 4,628,323 | 12/1986 | Crean | 343/765 |

FOREIGN PATENT DOCUMENTS

| | | | |
|---|---|---|---|
| 0213101 | 10/1985 | Japan | 343/840 |

*Primary Examiner*—William L. Sikes
*Assistant Examiner*—Doris J. Johnson
*Attorney, Agent, or Firm*—Sughrue, Mion, Zinn, Macpeak & Seas

[57] ABSTRACT

A telecommunications antenna is provided with a reflector having a semi-offset geometry, a feed mounted on a feed source rigidly fixed to the reflector, an antenna pedestal for supporting the reflector and the feed. Positioning of the feed is such that, in respect of a reflector illumination half-angle $\beta$ as seen from the feed such that $45° < \beta < 55°$, the offset angle $\alpha$ (angle between the focal axis $\Delta_{Foc}$ and the median ray of the total beam which is emitted by the feed and illuminates the reflector) is $25° < \alpha < 35°$, the antenna mount being of the azimuth-elevation type known as an az-el mount.

6 Claims, 3 Drawing Sheets

REFLECTOR ANTENNA FOR TELECOMMUNICATIONS

BACKGROUND OF THE INVENTION

1. Field of the Invention

The present invention relates to an antenna for use in the field of telecommunications.

2. Description of the Prior Art

It is a recognized fact that the development of telecommunications and in particular satellite communications (data reception and transmission, TV reception) calls for the use of antennas having increasingly sophisticated radio-propagation performances as well as mechanical performances. Nevertheless, the constant upward trend in the number of potential users is an incentive to the design of products which remain at low cost levels while at the same time achieving very high standards of efficiency.

Conventional antennas of the reflector type either have a paraboloidal structure (paraboloid of revolution) or an offset structure.

The paraboloidal antenna has the advantage of high polarization purity. However, the existence of aperture blocking by the radiation source, or so-called feed, essentially impairs the radiation efficiency and radiation diagrams.

The offset-structure antenna offers the advantage of freedom from aperture blocking by the feed but suffers, however, from low polarization purity.

These antennas are associated with standard mounts which can be either of the XY type or of the azimuth-elevation type (az-el mounts).

The main drawback of the XY mount lies in the absence of a vertical axis which makes it necessary for the operator to carry out conversions in order to change over to local references (horizontal and vertical references of the installation site location). This type of mount calls in addition for the use of conversion tables, which is liable to carry the penalty of a longer installation time.

Mounts f the az-el type having a vertical axis have an advantage in that the azimuth and elevation adjustments can be made independent of each other (the azimuth being expressed with reference to the geographic or magnetic north and the elevation being expressed with reference to the horizontal axis of the site location).

Antenna mounts at present available commercially (carrousel, barrel, tripod) are often complex and costly to construct.

SUMMARY OF THE INVENTION

The aim of the present invention is to overcome the disadvantages outlined in the foregoing and accordingly to propose a telecommunications antenna of the reflector type comprising a reflector of semi-offset geometry, a feed mounted on a feed support rigidly fixed to the reflector, an antenna pedestal for supporting the reflector and the feed. The distinctive feature of the antenna lies in the fact that the feed is positioned in such a manner as to ensure that, with respect to a reflector illumination half-angle $\beta$ as seen from the feed such that $45° < \beta < 55°$, the offset angle a (angle between the focal axis $\Delta_{Foc}$ and the median ray of the total beam which is emitted by the feed and illuminates the reflector) is $25° < \alpha < 35°$, and that the antenna mount is of the azimuth-elevation type known as an az-el mount.

The great advantage of an antenna of this type is that it has a small-diameter reflector and is so designed as to provide very high levels of performance in both transmission and reception of radio waves as well as mechanical performances which satisfy very strict requirements and great ease of installation while at the same time permitting industrial development based on low-cost technologies.

The antenna in accordance with the invention is a compromise between a symmetrical antenna and an offset antenna and thus makes it possible to arrive at a compromise between:

radiation efficiency: a structure of this type permits the achievement of 70% efficiency within a frequency band of 10.7 to 12.75 GHz and within a frequency band of 14 to 14.5 GHz;

the diagram of radiation in copolarization (polarization to be transmitted);

the level of contrapolarization.

The antenna offset angle is calculated so as to permit maximum gain and therefore maximum efficiency while maintaining very good contrapolarization, the beam reflected from the reflector being thus occulted in practice only to a very slight extent.

Moreover, an antenna of this type is made up of a very small number of components and can be constructed with great ease. Installation on site by an erector of average skill and proficiency takes less than one hour. The antenna has a compact structure and this feature in turn leads to a number of advantages such as, in particular, low wind resistance and small overhang.

DESCRIPTION OF THE PREFERRED EMBODIMENTS

Figure 1:
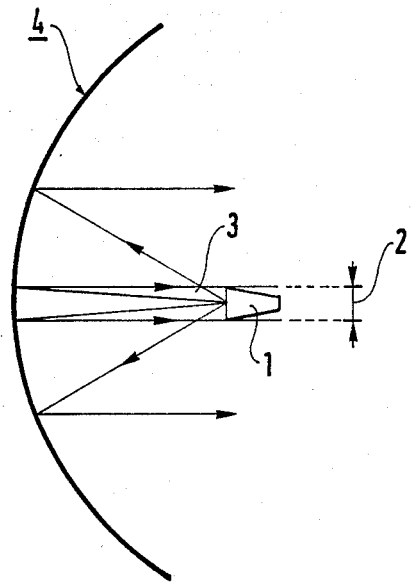
FIGS. 1 and 2 are two schematic views of devices in accordance with the prior art.

The antenna which is illustrated in FIG. 1 has a paraboloidal structure (paraboloid of revolution). The feed 1 forms an aperture mask 2 for the beam 3 which is reflected from the reflector 4.

Figure 2:
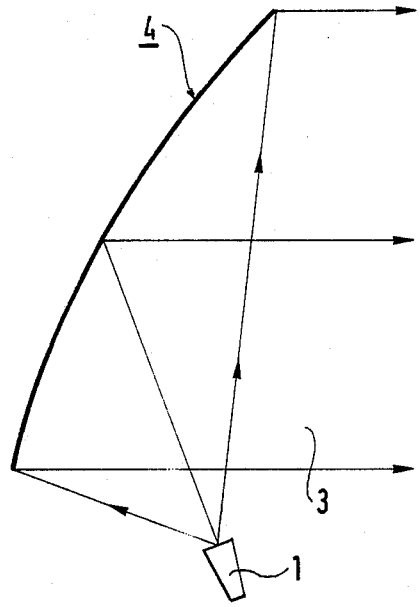

FIG. 2 illustrates an antenna having an offset structure. In this instance, the feed 1 is located outside the beam 3 reflected from the reflector 4.

Figure 3:
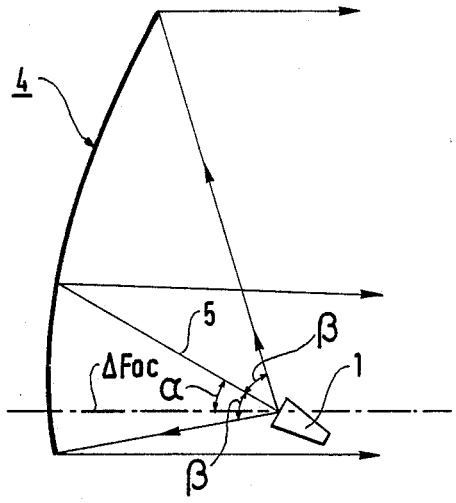
FIG. 3 is a schematic view of the antenna in accordance with the invention.

The antenna in accordance with the invention as shown in FIG. 3 includes a reflector 4 having a semi-offset geometry and a feed 1 which masks the beam 3 reflected from the reflector 4 only to a very limited extent. In this case, the offset angle $\alpha$ (angle between the focal axis $\Delta_{Foc}$ and the median ray 5 of the total beam which is emitted by the feed and illuminates the reflector) is $25° < \alpha < 35°$ when the reflector illumination half-angle $\beta$ as seen from the feed is $45° < \beta < 55°$.

Figure 4:
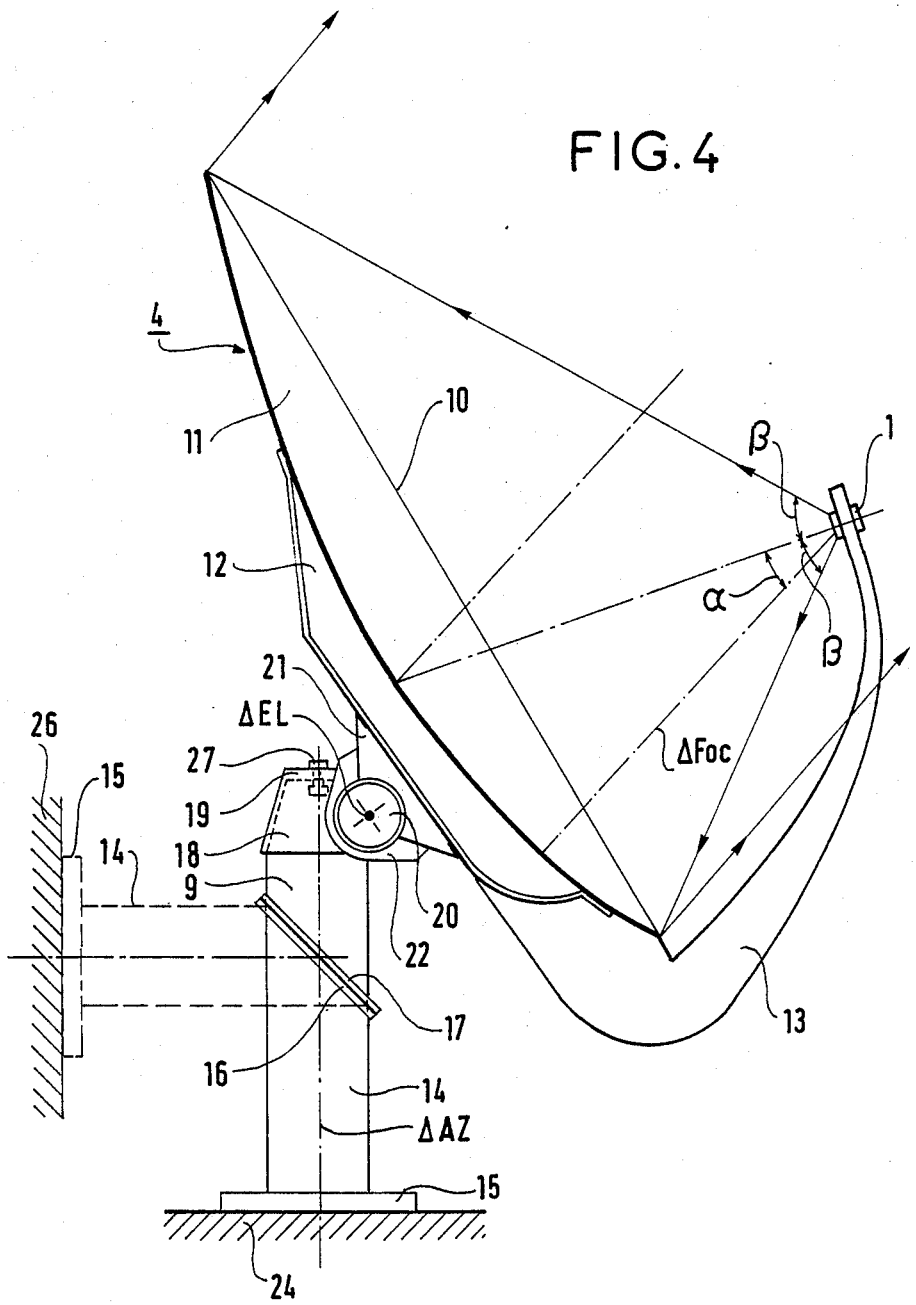
FIG. 4 is a view of an antenna in accordance with the invention.

An antenna in accordance with the invention and illustrated in FIG. 4 has the following components:

a reflector 10 having two faces as follows:

(a) a front face 11 which is the active face;

(b) a rear face 12, or reinforcement face, which has a dual function: it serves on the one hand to provide a rigid and relatively non-deformable shell in conjunction with the active face 11 and on the other hand to gather the forces produced by wind effects on the antenna mount;

a feed support 13 attached to the rear face 12;

a pedestal consisting of two sections:

(a) a lower section 14 or base formed by a cylindrical barrel which terminates at the lower end in fixing means 15 and at the upper end in a first inclined plane 16 set at an angle of 45°;

(b) an upper section 9, the lower end of which is provided with a second inclined plane 17 set at an angle of 45° and placed in contact with the first, the top end of said upper section 9 being surmounted by a cone 18;

an intermediate conical member 19 rigidly fixed to a shaft 20 which has an axis of symmetry ΔEL located at right angles to the axis ΔAZ of the cone and which extends on each side of this latter. Said conical member 19 is adapted to fit over the top cone 18 of the antenna pedestal;

two pairs of collars 21 and 22, each of which has respectively a first portion rigidly fixed to the rear face 12 and a second complementary portion for securing the shaft 20 to the rear face 12 while permitting rotation about the axis ΔAZ. These two pairs of fastening-collars 21 and 22 are located around the shaft 20 on each side of the conical member 19.

Figure 5:
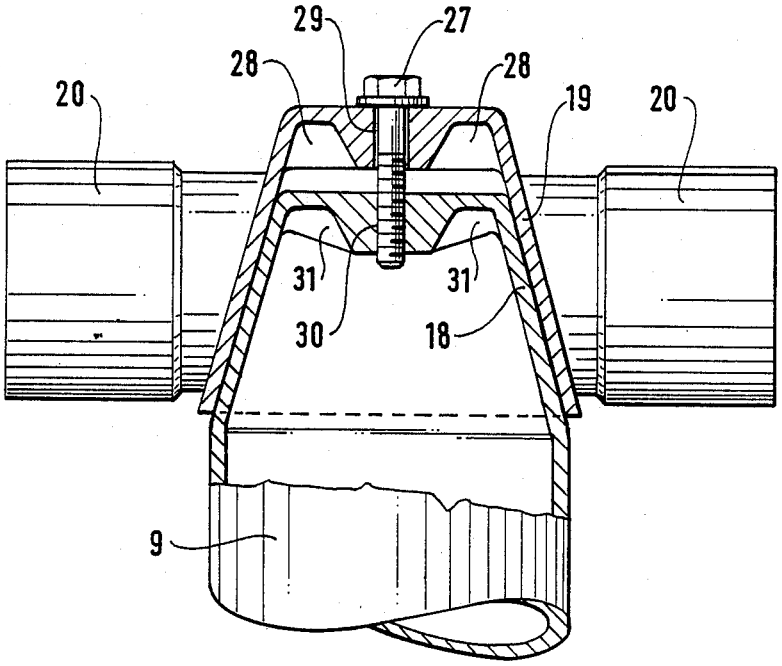
FIG. 5 is a fragmentary part-sectional view of the antenna in accordance with the invention.

The antenna mount is of the type known as an az-el mount. The interengagement of the two cones 18 and 19 as shown in FIG. 5 constitutes the azimuth axis ΔAZ whilst the shaft 20 defines the axis of elevation ΔEL.

The perpendicularity between these two axes ΔAZ and ΔEL is therefore ensured by the intermediate conical member 19 which is associated with the shaft 20.

By modifying the coupling of the two inclined planes 16 and 17, it is possible in a first position to secure the antenna in rigidly fixed relation to the ground 24 and in a second position to secure said antenna in rigidly fixed relation to a vertical wall 26.

The frictional contact of the two cones 18 and 19 one against the other is possible since the antenna can in particular be made of cast aluminum and is therefore of lightweight construction.

The ribs 31 and 28 located respectively beneath the internal faces of the lower cone 18 and upper cone 19 permit rigidification of the castings and are conducive to enhanced wind resistance of the antenna.

The aforementioned two cones 18 and 19 are pierced by bores 29 and 30 through which are passed a screw 27 for adjusting and locking these two cones with respect to each other, the second cone 30 being provided, for example, with a threaded portion which is complementary to the threaded portion of the screw 27. This adjusting and locking screw 27 in fact makes it possible to fix a position of the antenna in azimuth.

The upper cone 19 can be provided with a plurality of reference lugs, for example in order to position small equipment for supporting a compass which permits accurate orientation of the antenna when it is being placed in position.

The support 13 for the feed 1 is designed to minimize aperture blocking or masking of the waves reflected from the reflector and can have a transverse cross-section of pointed shape.

The radiation diagram of an antenna of this type makes it possible to obtain a very good margin with respect to commonly accepted standards (several dB below the envelope defined by: $G \leqq 49 - 10 \log (D/\lambda - 25 \log \theta)$.

In one example of construction, the antenna in accordance with the invention has the following characteristics:

radiating aperture: 1.20 m.

mechanical aperture: 1.20 m × 1.27 m (ellipse)

height: 1.55 m.

In a single-pole design, an antenna of this type permits reception of signals from satellites within a frequency band of 10.7 to 12.75 GHz.

In another design, an antenna of this type permits transmission and reception of signals as follows:

transmission within a frequency band of 14 to 14.5 GHz reception within a frequency band of 10.7 to 12.75 GHz.

The installation time for a complete antenna having a diameter of less than 1.50 m is approximately 15 minutes. The pointing accuracy is better than 0.1°. Antenna stability is better than 0.08° with a wind velocity of less than 20 m/s.

The design concept of the antenna may call for the use of low-cost technologies as follows:

for the antenna mount:

(a) aluminum alloy casting:
with sand;
by gravity chill casting;
under pressure;

(b) liquid forging;

(c) molding of thermoplastic or thermosetting material (with or without glass fiber reinforcement):
by compression;
by transfer compression;
by injection;

(d) die-stamping of reinforced thermoplastic material;

for the reflector:

(a) forming of aluminum sheets;

(b) molding of thermoplastic or thermosetting material (with or without glass fiber reinforcement) by hot-state or cold-state compression;

(c) die-stamping of reinforced thermoplastic material.

It is readily apparent that the present invention has been described in the foregoing with reference to the accompanying drawings solely by way of preferential example and that the constituent elements thereof may be replaced by equivalent elements without thereby departing either from the scope or the spirit of the invention.

What is claimed is:

1. A reflector-type telecommunications antenna comprising a reflector having a semi-offset geometry, a feed mounted on a feed support rigidly fixed to the reflector, an antenna pedestal for supporting the reflector and the feed, wherein the feed is positioned in such a manner as to ensure that, in respect of a reflector illumination half-angle $\beta$ as seen from the feed such that $45° < \beta < 55°$, the offset angle $\beta$ between the focal axis $\Delta_{Foc}$ and the median ray of the total beam which is emitted by the feed and which illuminates the reflector is $25° < \alpha < 35°$, and wherein said antenna mount is an azimuth-elevation type mount.

2. An antenna according to claim 1, wherein the antenna pedestal is composed of two sections:

a lower section or base formed by a cylindrical barrel which terminates at the lower end in fixing means and at the upper end in a first inclined plane set at an angle of 45°;

an upper section, the lower end of which is provided with a second inclined plane set at an angle of 45° and placed in contact with the first, the top end of said upper section being surrounded by a device coupling with the reflector and with the feed so as to permit of azimuth-elevation adjustment.

3. An antenna according to claim 1, wherein the feed support has a rounded side elevational shape and a pointed transverse cross-section so as to cause minimum interference with transmission of beams reflected from the reflector.

4. A reflector-type telecommunications antenna comprising:

a reflector having a semi-offset geometry;

a feed mounted on a feed support rigidly fixed to the reflector; and an azimuth-elevation antenna mount comprising an antenna pedestal for supporting the reflector and the feed, said antenna pedestal comprising a lower section or base formed by a cylindrical barrel which terminates at the lower end in fixing means and at the upper end in a first inclined plane set at an angle of 45°, and an upper section having a lower end provided with a second inclined plane set at an angle of 45° and placed in contact with the first inclined plane, said upper section having a top end surmounted by a coupling means for coupling with the reflector and feed so as to permit azimuth-elevation adjustment, said coupling means including upper and lower concentric cones in interengaged relation and capable of rotating with respect to each other about their axis of symmetry ΔAZ, the lower cone being the top end of the upper section of the antenna pedestal and the upper cone being an element of an intermediate member, said intermediate member being provided in addition with a shaft which has an axis of symmetry ΔEL located at right angles to the axis of symmetry ΔAZ of the upper cone and which extends on each side of said upper cone, and wherein two pairs of collars each have a first portion rigidly fixed to the rear face of the reflector and a second complementary portion for securing the shaft to the rear face while permitting rotation about the axis ΔEL, the two pairs of fastening-collars aforesaid being located concentrically around said shaft on each side of said upper cone.

said feed being positioned in such a manner as to ensure that, in respect of a reflector illumination half-angle $\beta$ as seen from the feed such that $45° < \beta < 55°$, the offset angle $\alpha$ between the focal axis $\Delta_{Foc}$ and the median ray of the total beam which is emitted by the feed and which illuminates the reflector is $25° < \alpha 35°$.

5. An antenna according to claim 4, wherein the lower cone and the upper cone are provided with internal rigidification ribs.

6. An antenna according to claim 4, wherein the two cones are pierced by bores through which is passed a screw for adjusting and locking said cones with respect to each other.

* * * * *